US007548221B2

(12) United States Patent
Kim et al.

(10) Patent No.: US 7,548,221 B2
(45) Date of Patent: Jun. 16, 2009

(54) PLASMA DISPLAY PANEL AND DRIVING METHOD THEREOF

(75) Inventors: Tae-Seong Kim, Suwon-si (KR); Woo-Joon Chung, Suwon-si (KR); Jin-Sung Kim, Suwon-si (KR); Seung-Hun Chae, Suwon-si (KR); Kyoung-Ho Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 756 days.

(21) Appl. No.: 10/955,334

(22) Filed: Sep. 30, 2004

(65) Prior Publication Data

US 2005/0093772 A1 May 5, 2005

(30) Foreign Application Priority Data

Oct. 1, 2003 (KR) ..... 10-2003-0068368

(51) Int. Cl.
*G09G 5/00* (2006.01)

(52) U.S. Cl. ..... 345/60; 345/63; 345/68

(58) Field of Classification Search ..... 345/60–72, 345/30, 211, 3.2; 315/169.4
See application file for complete search history.

(56) References Cited

U.S. PATENT DOCUMENTS

| | | | | |
|---|---|---|---|---|
| 6,262,699 | B1 * | 7/2001 | Suzuki et al. | 345/68 |
| 6,344,839 | B1 * | 2/2002 | Denda et al. | 345/60 |
| 2001/0045924 | A1 * | 11/2001 | Huang | 345/63 |
| 2003/0058476 | A1 * | 3/2003 | Kwon et al. | 358/3.02 |
| 2003/0218432 | A1 * | 11/2003 | Song et al. | 315/169.1 |

* cited by examiner

*Primary Examiner*—Amare Mengistu
*Assistant Examiner*—Jennifer Zubajlo
(74) *Attorney, Agent, or Firm*—Christie, Parker & Hale, LLP

(57) ABSTRACT

A plasma display panel (PDP) and a method for driving the PDP. An ON/OFF pattern of an externally-inputted image signal is checked to sense a sustained discharge occurring in discharge cells respectively corresponding to scan electrodes included in a particular one of multiple scan electrode groups over a predetermined time. A control operation is carried out in response to the sensing of the sustained discharge to allow a discharge to occur in discharge cells respectively corresponding to scan electrodes included in the scan electrode groups other than the particular scan electrode group.

15 Claims, 7 Drawing Sheets

PLASMA DISPLAY PANEL AND DRIVING METHOD THEREOF

CROSS REFERENCE TO RELATED APPLICATION

This application claims priority to and the benefit of Korean Patent Application No. 2003-68368 filed on Oct. 1, 2003, in the Korean Intellectual Property Office, the entire contents of which are incorporated herein by reference.

BACKGROUND OF THE INVENTION (a) Field of the Invention

The present invention relates to a plasma display panel (PDP), and, more particularly, to an apparatus and method to drive a PDP.

(b) Description of the Related Art

Recently, flat panel displays, such as liquid crystal displays (LCDs), field emission displays (FEDs) and PDPs, have been actively developed. The PDPs are advantageous over the other flat panel displays in regard to their high luminance, high luminous efficiency and wide viewing angle. Accordingly, the PDPs are being highlighted as a substitute for conventional cathode ray tubes (CRTs) for large-screen displays of more than 40 inches.

The PDPs are flat panel displays that use plasma generated by gas discharge to display characters or images. The PDPs include, according to their size, more than several tens to millions of pixels arranged in the form of a matrix. These PDPs are classified into a direct current (DC) type and an alternating current (AC) type according to patterns of waveforms of driving voltages applied thereto and discharge cell structures thereof.

The DC PDP has electrodes exposed to a discharge space, thereby causing current to directly flow through the discharge space during application of a voltage to the DC PDP. In this connection, the DC PDP has a disadvantage in that it requires a resistor for limiting the current. On the other hand, the AC PDP has electrodes covered with a dielectric layer that naturally forms a capacitance component to limit the current and protects the electrodes from the impact of ions during a discharge. As a result, the AC PDP is superior over the DC PDP in regard to a long lifetime.

Such an AC PDP includes scan electrodes and sustain electrodes formed on one main surface of the PDP and arranged in parallel, and address electrodes formed on the other main surface of the PDP and extending in a direction orthogonal to the scan electrodes and sustain electrodes. The sustain electrodes correspond to respective scan electrodes, and are coupled in common.

FIG. 1 is a perspective view illustrating part of an AC PDP. Scan electrodes 4 and sustain electrodes 5 covered with dielectric layer 2 and protective layer 3 are arranged in pairs in parallel on first glass substrate 1. A plurality of address electrodes 8 covered with insulation layer 7 are arranged on second glass substrate 6. Partition walls 9 are formed in parallel with address electrodes 8 on insulation layer 7 such that each partition wall 9 is interposed between adjacent address electrodes 8. Fluorescent material 10 is coated on the surface of insulation layer 7 and on both sides of each partition wall 9. First and second glass substrates 1, 6 are arranged to face each other while defining discharge space 11 therebetween so that address electrodes 8 are orthogonal to scan electrodes 4 and sustain electrodes 5. In the discharge space, discharge cell 12 is formed at an intersection between each address electrode 8 and each pair of scan electrodes 4 and sustain electrodes 5.

FIG. 2 shows an arrangement of the electrodes in the PDP. The electrodes of the PDP are arranged in the form of an m x n matrix. m address electrodes A1 to Am are arranged in a column direction. n scan electrodes Y1 to Yn and n sustain electrodes X1 to Xn are alternately arranged in a row direction. Hereinafter, the scan electrodes are referred to as "Y-electrodes", and the sustain electrodes are referred to as "X-electrodes".

There are various methods to display a frame by discharging cells of a PDP, such as the subfield method and the line erase scanning method. In the subfield method, one frame to be displayed in accordance with a cell discharge is divided into a plurality of sub-frames. The sub-frames are overlapped under the control of drivers for sustain electrodes and address electrodes to realize the display of one frame.

FIG. 3 illustrates driving waveforms of a conventional subfield method. As In the conventional subfield method, an address operation (write period) and a sustained discharge operation are carried out for every subfield wherein the electrodes are driven such that they are divided into a plurality of groups. However, when a number of sustain pulses are concentratedly applied to a particular electrode group in the above-mentioned PDP driving method, elements to drive the electrode group may be overloaded, thereby generating a large amount of heat. For this reason, the elements may be damaged.

SUMMARY OF THE INVENTION

In accordance with the present invention an apparatus and method is provided to drive a PDP which are capable of preventing particular elements of the PDP from being overloaded.

In accordance with one aspect, the present invention provides a plasma display panel device. A plasma display panel includes a plurality of address electrodes, a plurality of scan electrodes divided into a first scan electrode group and a second scan electrode group, and a plurality of scan electrodes. A controller corrects an externally-inputted image signal, and thus, outputs the corrected image signal. An address driver generates address data corresponding to data outputted from the controller and applies the address data to the address electrodes. A first scan driver generates scan pulse data corresponding to data outputted from the controller as a scan driving signal and applies the scan pulse data to the scan electrodes included in one of the first and second scan electrode groups. A second scan driver generates scan pulse data corresponding to the data outputted from the controller as the scan driving signal and applies the scan pulse data from the second scan driver to the scan electrodes included in the other of the first and second scan electrode groups. A sustain driver generates sustain pulse data corresponding to data outputted from the controller and applies the sustain pulse data to the sustain electrodes, wherein each of the first and second scan drivers applies the scan pulse data generated therefrom to the scan electrodes included in an associated one of the first and second scan electrode groups in response to a control signal from the controller.

The controller may sense a sustained discharge occurring in discharge cells respectively corresponding to the scan electrodes included in one of the first and second scan electrode group over a predetermined time, convert the scan driving signal in response to the sensing of the sustained discharge, and output the scan driving signal to the first and second scan drivers such that a discharge occurs in discharge cells respectively corresponding to the scan electrodes included in the other of the first and second scan electrode group.

The controller may comprise an image data processor to correct the image signal, and to output the corrected image signal; a subfield data generator to convert the image signal from frame data into subfield data; an ON/OFF pattern sensor to check an ON/OFF pattern of the image signal; and a data converter to convert an output signal from the subfield data generator, based on an output signal from the subfield data generator.

The ON/OFF pattern sensor may check the ON/OFF pattern from the frame data or subfield data.

The first scan electrode group may include odd-line ones of the scan electrodes included in the plasma display panel, and the second scan electrode group may include even-line ones of the scan electrodes included in the plasma display panel.

In accordance with another aspect, the present invention provides a plasma display panel device. A plasma display panel inlcudes a first scan electrode group having a plurality of scan electrodes, and a second scan electrode group having a plurality of scan electrodes. A first scan driver generates scan pulse data corresponding to data outputted from a controller, and applies the scan pulse data to the scan electrodes included in one of the first and second scan electrode groups. A second scan driver generates scan pulse data corresponding to the data outputted from the controller and applies the scan pulse data from the second scan driver to the scan electrodes included in the other of the first and second scan electrode groups. A switching unit couples the first and second scan drivers and the first and second scan electrode groups. The controller controls a coupling between the switching unit and the first and second scan drivers, wherein the switching unit couples the fist and second scan drivers and the first and second scan electrode groups such that one of the first and second scan drivers applies the scan pulse data outputted therefrom to the scan electrodes included in one of the first and second scan electrode groups, and the other of the first and second scan drivers applies the scan pulse data outputted therefrom to the scan electrodes included in the other of the first and second scan electrode groups.

The controller may sense a sustained discharge occurring in discharge cells respectively corresponding to the scan electrodes included in one of the first and second scan electrode group over a predetermined time, and switch, in response to the sensing of the sustained discharge, the coupling between the first and second scan drivers and the first and second scan electrode groups such that a discharge occurs in discharge cells respectively corresponding to the scan electrodes included in the other of the first and second scan electrode group.

The switching unit may comprise: a first switch to couple the first scan electrode group and the first scan driver; a second switch to couple the first scan electrode group and the second scan driver; a third switch to couple the second scan electrode group and the first scan driver; and a fourth switch to couple the second scan electrode group and the second scan driver.

The first scan electrode group may include odd-line ones of the scan electrodes included in the plasma display panel, and the second scan electrode group may include even-line ones of the scan electrodes included in the plasma display panel.

In accordance with another aspect, the present invention provides a method to drive a plasma display panel device including a first scan electrode group having a plurality of scan electrodes, a second scan electrode group having a plurality of scan electrodes, a first scan driver to apply scan pulse data to the scan electrodes included in one of the first and second scan electrode groups, and a second scan driver to apply the scan pulse data to the scan electrodes included in the other of the first and second scan electrode groups. The method includes: outputting the scan pulse data to the first and second scan electrode groups by the first and second drivers, respectively; and outputting, in response to a control signal, another scan pulse data to the first and second scan electrode groups by the first and second drivers, respectively.

The control signal may be a signal for sensing generation of a sustained discharge at discharge cells respectively corresponding to the scan electrodes included in one of the first and second scan electrode group over a predetermined time in accordance with checking of an ON/OFF pattern of an externally-inputted image signal, and controlling a discharge to occur in discharge cells respectively corresponding to the scan electrodes included in the other of the first and second scan electrode group, and the control signal is used to check an ON/OFF pattern of a frame-based image signal, and output subfield-based converted image data based on the result of sensing the ON/OFF pattern.

DETAILED DESCRIPTION

Figure 1:
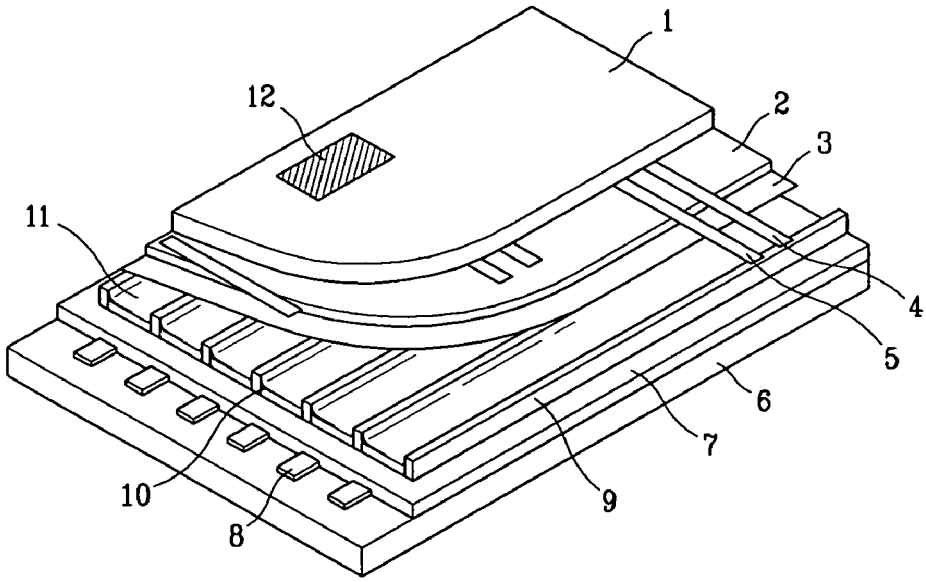
FIG. 1 (Prior Art)
FIG. 1 is a perspective view illustrating a part of a conventional AC PDP.
Figure 2:
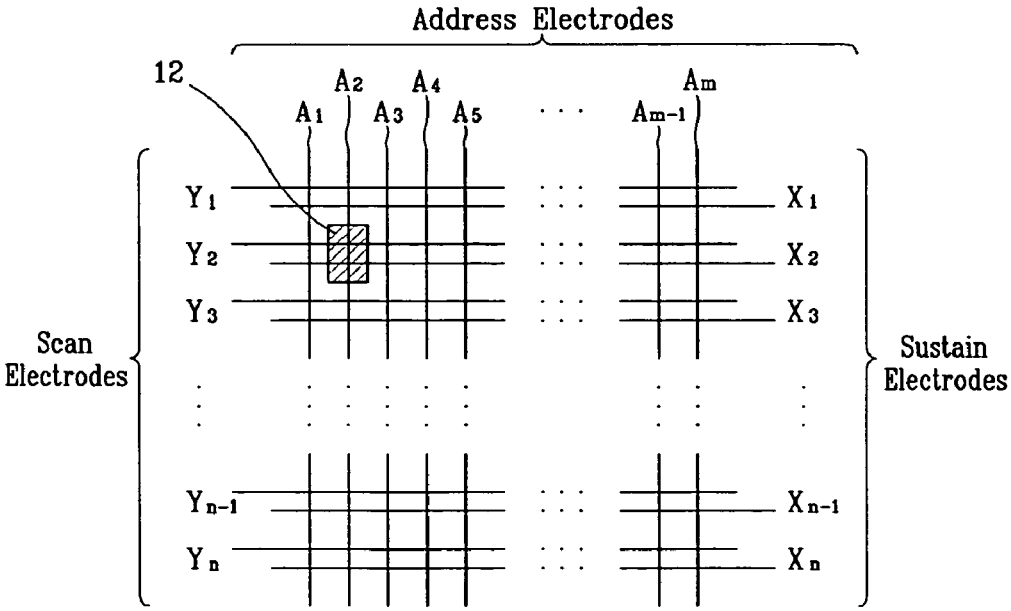
FIG. 2 (Prior Art)
FIG. 2 is a schematic view illustrating an arrangement of electrodes in the PDP.
Figure 3:
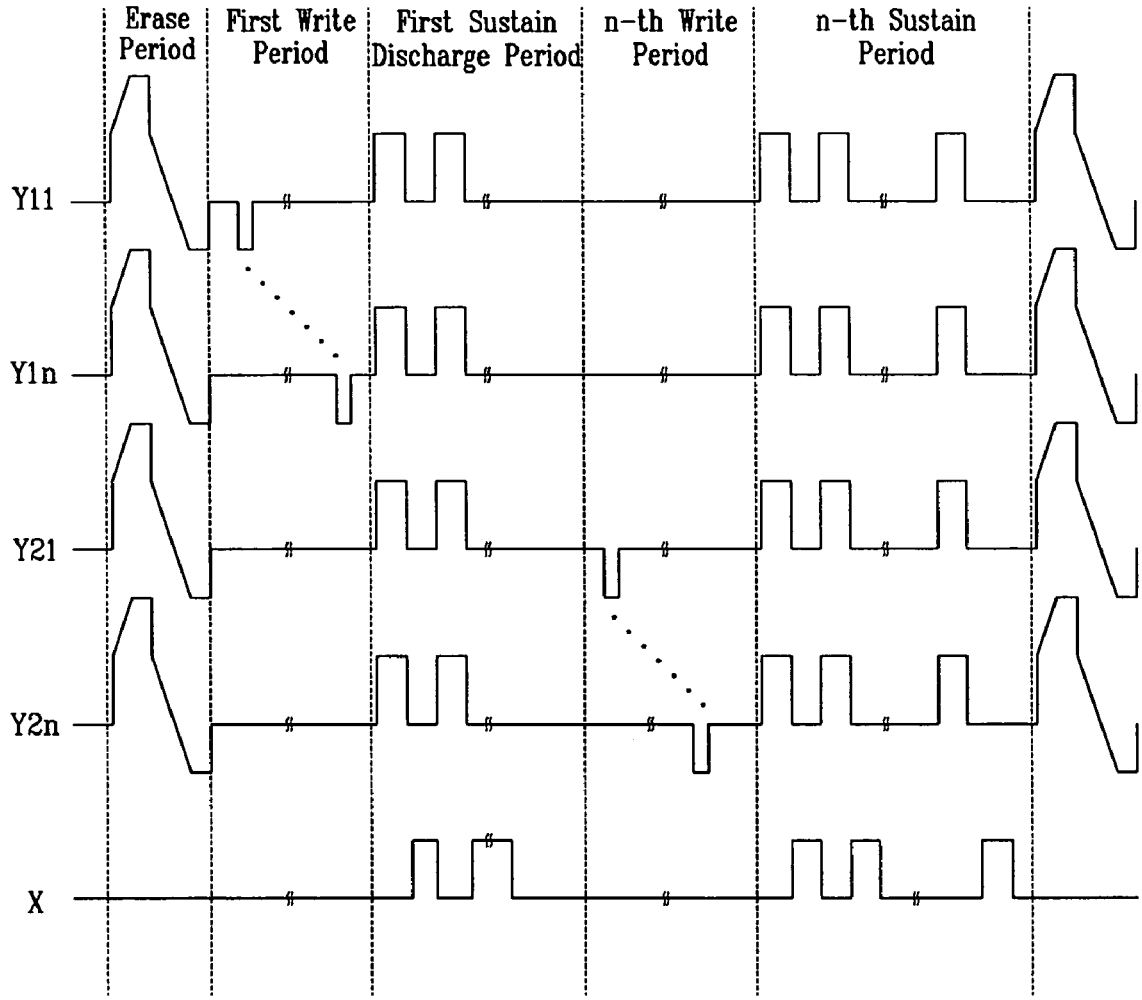
FIG.3(Prior Art)
FIG. 3 is a waveform diagram illustrating driving waveforms according to a conventional subfield method.
Figure 4A:
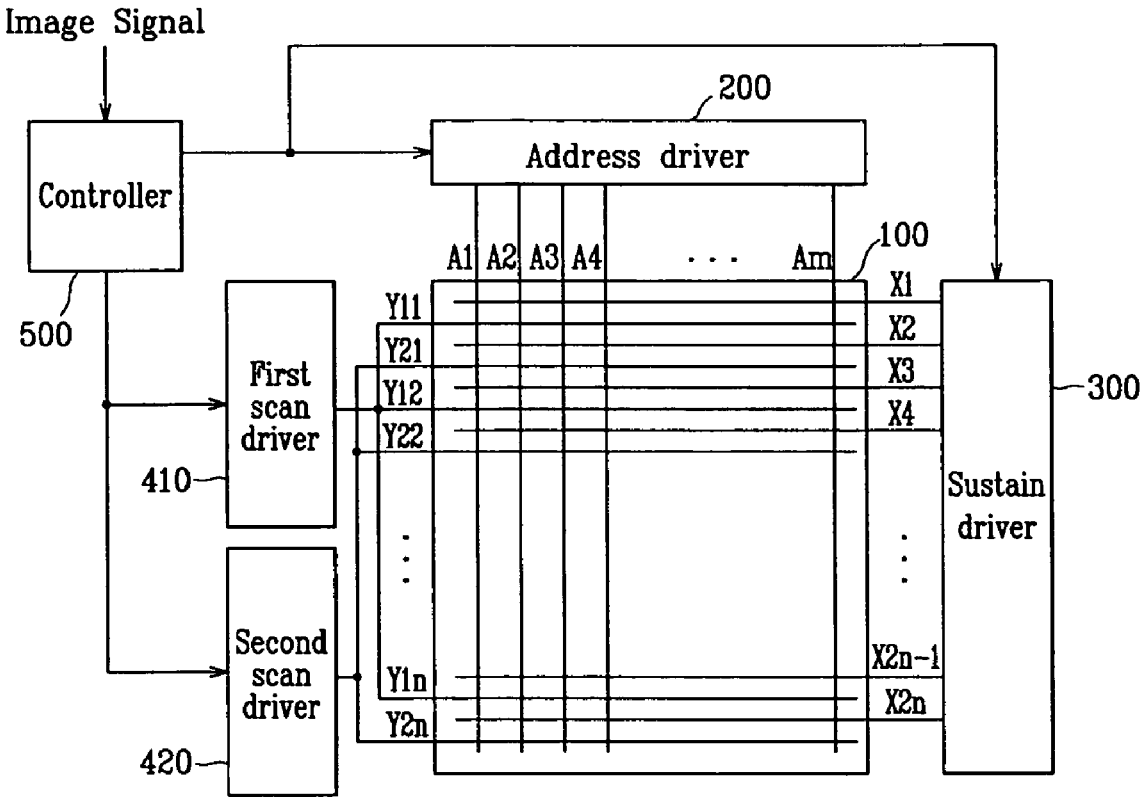
FIGS. 4*a* and 4*b* are block diagrams of a PDP according to respective first and second embodiments of the present invention.

A PDP driving device according to a first embodiment of the present invention will now be described in detail with reference to FIGS. 4*a* and 5. As shown in FIG. 4*a*, the PDP includes plasma display panel 100, address driver 200, sustain driver 300, first scan driver 410, second scan driver 420, and controller 500.

Plasma display panel 100 includes a plurality of address electrodes A1 to Am arranged in the column direction, and a plurality of scan electrodes Y11 to Y1*n* and Y21 to Y2*n* and a plurality of sustain electrodes X1 to X2*n* alternately arranged in a row direction.

Address driver 200 receives an address driving control signal from controller 500, and applies display data signals to respective address electrodes A1 to Am for selecting desired discharge cells.

Sustain driver 300 and first and second scan drivers 410, 420 receive sustain discharge signals from controller 500, and alternately apply sustain pulse voltages to the sustain electrodes and the scan electrodes, respectively, thereby causing selected discharge cells to perform a sustained discharge. In this case, the scan electrodes are driven in a state of being divided into two groups, that is, an odd group and an even group. That is, first scan driver 410 applies a driving signal to the odd scan electrodes, and second scan driver 420 applies a driving signal to the even scan electrodes.

Controller 500 externally receives an image signal, and generates an address driving control signal and sustain discharge signals, based on the received image signal. Controller 500 applies the address driving control signal to address driver 200, while applying the sustain discharge signals to sustain driver 300 and first and second scan drivers 410, 420, respectively.

Figure 5:
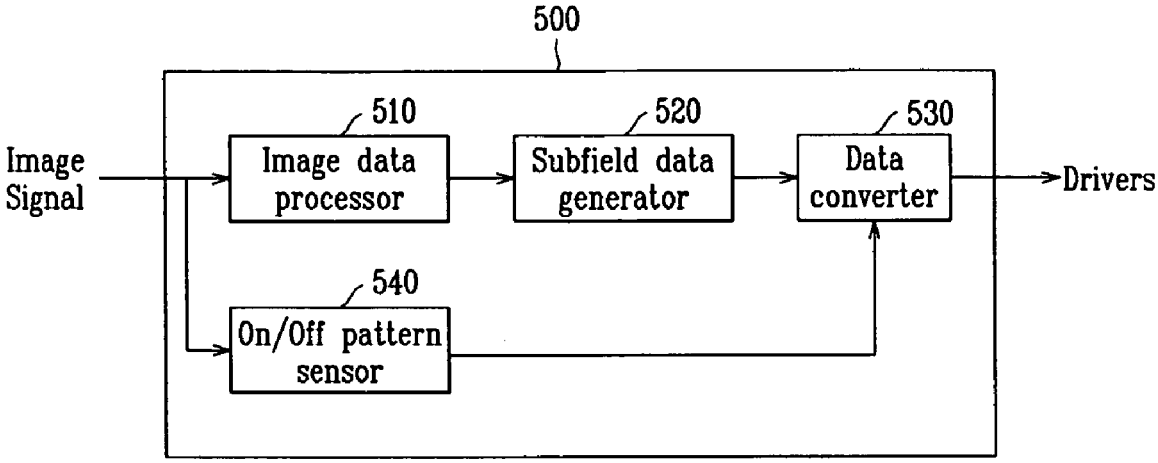
FIG. 5 is a block diagram illustrating an inner configuration of the controller shown in FIG. 4*a*.

Referring to FIG. 5, controller 500 in the PDP according to the first embodiment of the present invention includes image data processor 510, subfield data generator 520, data converter 530, and ON/OFF pattern sensor 540.

Image data processor 510 corrects an input image signal in units of frames. Subfield data generator 520 converts each frame of the corrected image signal into subfield data so that the PDP is driven for every subfield of the image signal. ON/OFF pattern sensor 540 checks an ON/OFF pattern of each frame of the image signal. Data converter 530 converts an output signal of subfield data generator 520, based on an output signal from ON/OFF pattern sensor 540, and outputs the converted signal to the drivers.

That is, when ON/OFF pattern sensor 540 senses that a sustained discharge operation occurs in a particular group of the scan electrodes (the even scan electrode group or odd scan electrode group) over a predetermined time, after checking the ON/OFF pattern of the frame of the image signal inputted to ON/OFF pattern sensor 540, the resultant sensing signal is outputted from ON/OFF pattern sensor 540 to data converter 530. In response to the sensing signal from ON/OFF pattern sensor 540, data converter 530 converts the output signal of subfield data generator 520 such that the sustained discharge in the particular scan electrode group no longer occurs, and the other scan electrode group is driven.

For example, when it is sensed that a sustained discharge operation occurs in the even scan electrode group over the predetermined time, the subfield data is converted such that a sustained discharge operation occurs in the odd scan electrode group, in place of the even scan electrode group.

When ON/OFF pattern sensor 540 senses that the sustained discharge operation occurring in the odd scan electrode group is continued over the predetermined time, after checking the ON/OFF pattern of the frame of the image signal inputted to the ON/OFF pattern sensor 540, the resultant sensing signal is outputted from ON/OFF pattern sensor 540 to data converter 530. In response to the sensing signal from ON/OFF pattern sensor 540, data converter 530 converts the output signal of subfield data generator 520 such that the even scan electrode group is driven, in place of the odd scan electrode group.

Although the ON/OFF pattern sensing is carried out for every frame in accordance with the first embodiment of the present invention, it may be carried out for every subfield. Hereinafter, this embodiment will be described in detail with reference to FIG. 6.

Figure 4B:
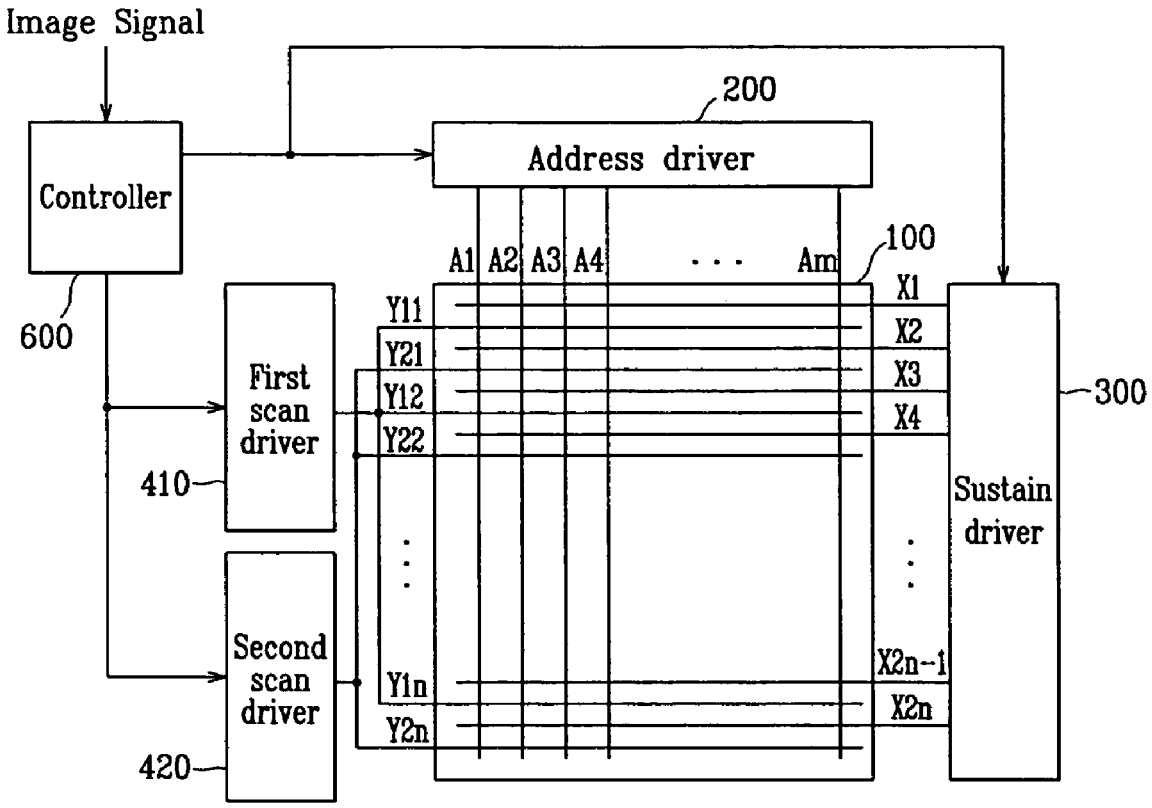
Figure 6:
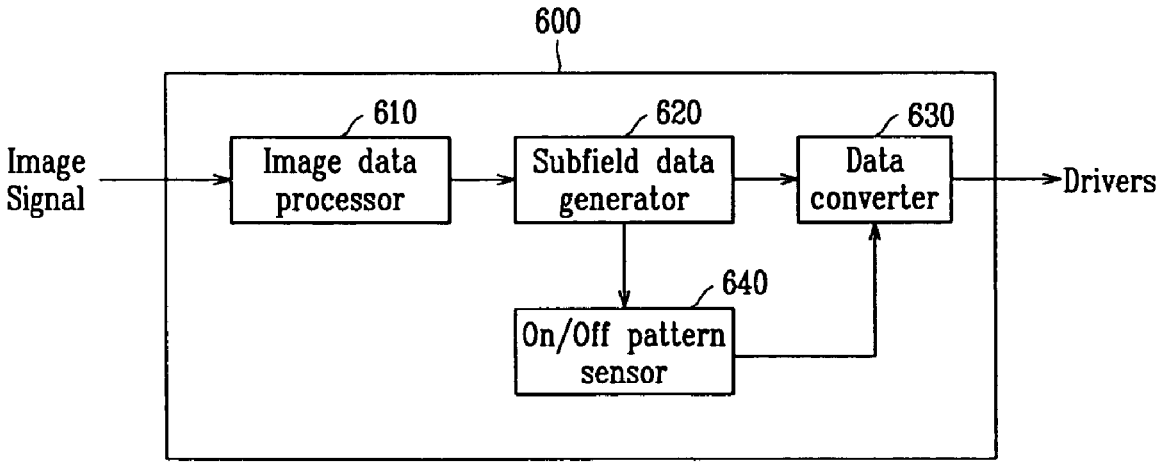
FIG. 6 is a block diagram illustrating an inner configuration of the controller shown in FIG. 4*b*.

Referring now to FIGS. 4*b* and 6, the PDP according to the second embodiment of the present invention has the same configuration as the first embodiment, with the exception of controller 600. As shown in FIG. 4*b*, the PDP includes plasma display panel 100, address driver 200, sustain driver 300, first scan driver 410, second scan driver 420, each operating as set forth above for the first embodiment, and controller 600. Controller 600 includes image data processor 610, subfield data generator 620, data converter 630, and ON/OFF pattern sensor 640. However, while ON/OFF pattern sensor 540 included in the controller according to the first embodiment of the present invention checks the ON/OFF pattern of frame data, ON/OFF pattern sensor 640 included in the controller according to the second embodiment of the present invention checks the ON/OFF pattern of subfield data.

That is, in accordance with the second embodiment of the present invention, when ON/OFF pattern sensor 640 senses that a sustained discharge operation occurs in a particular group of the scan electrodes (the even scan electrode group or odd scan electrode group) over a predetermined time, after checking the ON/OFF pattern of the subfield of the image signal inputted to ON/OFF pattern sensor 640, the resultant sensing signal is outputted from ON/OFF pattern sensor 640 to data converter 630. In response to the sensing signal from ON/OFF pattern sensor 640, data converter 630 converts the output signal of subfield data generator 620 such that the sustained discharge in the particular scan electrode group occurs no longer, and the other scan electrode group is driven.

Although a sustained discharge in a particular scan electrode group over the predetermined time is prevented by converting frame or subfield data in accordance with the first or second embodiment of the present invention, this may be prevented by switching the coupling between the first and second scan drivers and the scan electrode groups.

Figure 7A:
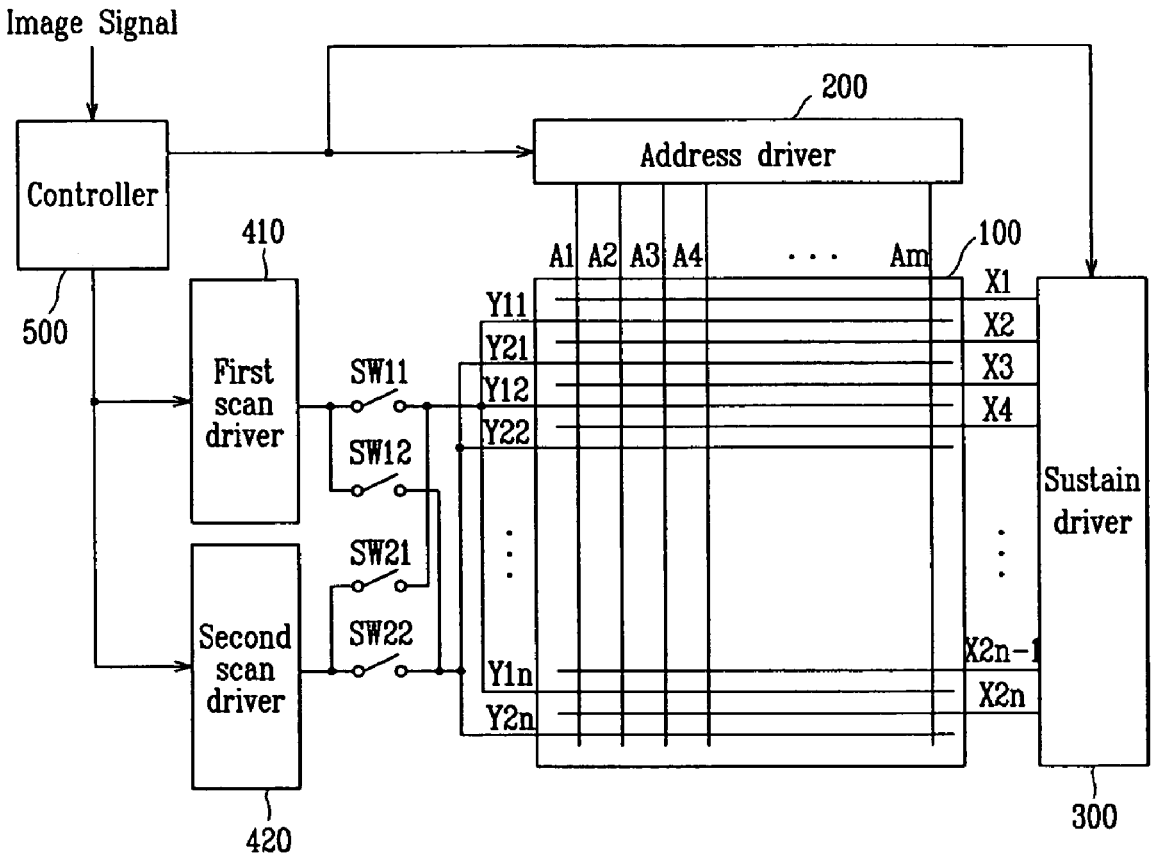
FIGS. 7*a* and 7*b* are block diagrams of an apparatus to drive a PDP according to respective third and fourth embodiments of the present invention.
Figure 7B:
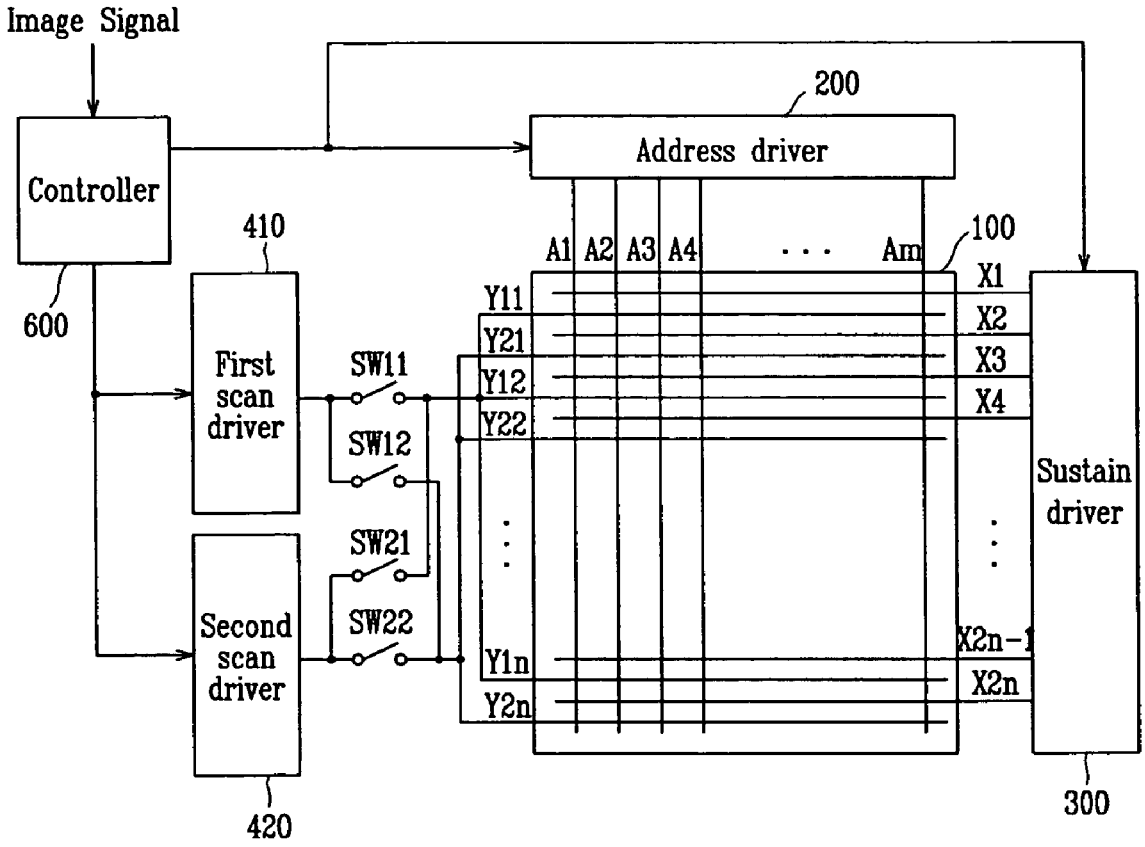

As shown in FIGS. 7*a* and 7*b*, the PDP according to respective third and fourth embodiments of the present invention has the same configuration as the first and second embodiments, except that four switches SW11, SW12, SW21 and SW22 are coupled between the first and second scan drivers and the scan electrodes.

The scan electrodes are driven in a state of being divided into an odd group and an even group. Switch SW11 is coupled between first scan driver 410 and the scan electrodes of the odd scan electrode group. Switch SW12 is coupled between second scan driver 410 and the scan electrodes of the even scan electrode group. Switch SW21 is coupled between second scan driver 420 and the scan electrodes of the odd scan electrode group. Switch SW22 is coupled between second scan driver 410 and the scan electrodes of the even scan electrode group.

Accordingly, each of first and second scan drivers 410, 420 applies a drive signal to the even or odd scan electrodes in accordance with a selective coupling between the associated first or second scan driver 410, 420 and the associated switch SW11 or SW12 or switch SW21 or SW22.

During normal operation, first scan driver 410 applies a drive signal to the odd scan electrodes, and second scan driver 420 applies a drive signal to the even scan electrodes because switches SW11 and SW22 are in their ON states, respectively.

However, when ON/OFF pattern sensors 540, 640 of controllers 500, 600 sense that a sustained discharge operation occurs in a particular scan electrode group over a predetermined time, they switch off their switches SW11 and SW22, and switch on their switches SW12 and SW21. As a result, first scan driver 410 applies a drive signal to the even scan electrodes, and second scan driver 420 applies a drive signal to the odd scan electrodes.

When ON/OFF pattern sensors 540, 640 subsequently sense that a sustained discharge operation occurs in a particular scan electrode group over the predetermined time, they switch off switches SW12 and SW21, and switch on switches SW11 and SW22. As a result, first scan driver 410 applies a drive signal to the odd scan electrodes, and second scan driver 420 applies a drive signal to the even scan electrodes.

As is apparent from the above description, in accordance with the present invention, it is possible to prevent particular elements of a PDP from being overloaded in a sustained discharge period, and thus, to prevent the elements from operating abnormally due to the overload and from being shortened in lifetime. An improvement in the reliability of products is also achieved.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel device comprising:

a plasma display panel having a plurality of address electrodes, a plurality of scan electrodes divided into a first scan electrode group and a second scan electrode group, and a plurality of sustain electrodes;

a controller for correcting an externally-inputted image signal and outputting a corrected image signal;

an address driver for generating address data signals corresponding to an address driving control signal outputted from the controller and applying the address data signals to the address electrodes;

a first scan driver for generating scan pulse voltages corresponding to sustain discharge signals outputted from the controller as a scan driving signal and applying the scan pulse voltages to the scan electrodes included in one of the first scan electrode group and the second scan electrode group;

a second scan driver for generating scan pulse voltages corresponding to the sustain discharge signals outputted from the controller as the scan driving signal, and applying the scan pulse voltages to the scan electrodes included in the other of the first scan electrode group and the second scan electrode group; and a sustain driver for generating sustain pulse voltages corresponding to the sustain discharge signals outputted from the controller and applying the sustain pulse voltages to the sustain electrodes, wherein each of the first scan driver and the second scan driver applies the scan pulse voltages generated respectively therefrom to the scan electrodes included in an associated one of the first scan electrode group and second scan electrode group in response to a control signal from the controller, and wherein the controller senses a sustained discharge occurring in discharge cells corresponding to the scan electrodes in one of the first scan electrode group and the second scan electrode group over a predetermined time, and, in response to such sensing of the sustained discharge, outputs the scan driving signal such that a discharge occurs in discharge cells corresponding to the scan electrodes in the other of the first scan electrode group and the second scan electrode group.

2. The plasma display panel device of claim 1, wherein:

the first scan electrode group includes odd-line ones of the scan electrodes included in the plasma display panel; and the second scan electrode group includes even-line ones of the scan electrodes included in the plasma display panel.

3. The plasma display panel device of claim 1, wherein the controller comprises:

an image data processor for correcting the image signal and outputting the corrected image signal;

a subfield data generator for converting the image signal from frame data into subfield data;

an ON/OFF pattern sensor for checking an ON/OFF pattern of the image signal; and a data converter for converting an output signal from the subfield data generator based on output signals from the subfield data generator and the ON/OFF pattern sensor, and outputting a converted signal.

4. The plasma display panel device of claim 3, wherein the ON/OFF pattern sensor checks the ON/OFF pattern from the frame data.

5. The plasma display panel device of claim 3, wherein the ON/OFF pattern sensor checks the ON/OFF pattern from the subfield data.

6. A plasma display panel device comprising:

a plasma display panel including a first scan electrode group having a plurality of first scan electrodes, and a second scan electrode group having a plurality of second scan electrodes;

a first scan driver for generating scan pulse voltages corresponding to sustain discharge signals outputted from a controller, and applying the scan pulse voltages from the first scan driver to scan electrodes included in one of the first scan electrode group and the second scan electrode group;

a second scan driver for generating scan pulse voltages corresponding to the sustain discharge signals outputted from the controller, and applying the scan pulse voltages from the second scan driver to scan electrodes included in the other of the first scan electrode group and the second scan electrode group;

a switching unit for coupling the first scan driver and the second scan driver to the first scan electrode group and the second scan electrode group; and a controller for controlling coupling between the switching unit and the first scan driver and the second scan driver, wherein the switching unit couples the first scan driver and the second scan driver to the first scan electrode group and the second scan electrode group such that one of the first scan driver and the second scan driver applies the scan pulse voltages outputted from the one of the first scan driver and the second scan driver to the scan electrodes included in one of the first scan electrode group and the second scan electrode group, and the other of the first scan driver and the second scan driver applies the scan pulse voltages outputted from the other of the first scan driver and the second scan driver to the scan electrodes included in the other of the first scan electrode group and the second scan electrode group in response to a control signal from the controller, and wherein the controller senses a sustained discharge occurring in discharge cells corresponding to the scan electrodes in one of the first scan electrode group and the second scan electrode group over a predetermined time, and, in response to the sensing of the sustained discharge, switches a coupling between the first scan driver and the second scan driver and the first scan electrode group and the second scan electrode group such that a discharge occurs in discharge cells corresponding to the scan electrodes in the other of the first scan electrode group and second scan electrode group.

7. The plasma display panel device of claim 6, wherein:

the first scan electrode group includes odd-line scan electrodes included in the plasma display panel; and the second scan electrode group includes even-line scan electrodes included in the plasma display panel.

8. The plasma display panel device of claim 6, wherein the switching unit comprises:

a first switch for coupling the first scan electrode group and the first scan driver;

a second switch for coupling the first scan electrode group and the second scan driver;

a third switch for coupling the second scan electrode group and the first scan driver; and a fourth switch for coupling the second scan electrode group and the second scan driver.

9. A method to drive a plasma display panel including a first scan electrode group having a plurality of scan electrodes, a second scan electrode group having a plurality of scan electrodes, a first scan driver for applying scan pulse voltages to the scan electrodes included in one of the first scan electrode group and the second scan electrode group, and a second scan driver for applying scan pulse voltages to the scan electrodes included in the other of the first scan electrode group and the second scan electrode group, comprising:

outputting by the first scan driver and the second scan driver the scan pulse voltages to the first scan electrode group and the second scan electrode group respectively; and outputting by the first scan driver and the second scan driver in response to a control signal additional scan pulse voltages to the first scan electrode group and the second scan electrode group respectively, wherein the control signal is a signal used for sensing generation of a sustained discharge at discharge cells corresponding to the scan electrodes included in one of the first scan electrode group and the second scan electrode group over a predetermined time in accordance with checking of an ON/OFF pattern of an externally-inputted image signal, and, in response to such sensing of the sustained discharge, controlling a discharge to occur in discharge cells corresponding to the scan electrodes in the other of the first scan electrode group and the second scan electrode group.

10. The method of claim 9, wherein the control signal is used to check an ON/OFF pattern of a frame-based image signal, and to output subfield-based converted image data based on the result of sensing the ON/OFF pattern.

11. The method of claim 9, wherein the control signal is used to check an ON/OFF pattern of a subfield-based image signal, and to output subfield-based converted image data based on the result of sensing the ON/OFF pattern.

12. A scan driver apparatus for a plasma display panel including a first scan electrode group having a plurality of scan electrodes, a second scan electrode group having a plurality of scan electrodes comprising:

a first scan driver for applying scan pulse voltages to scan electrodes included in one of the first scan electrode group and the second scan electrode group; and a second scan driver for applying scan pulse voltages to scan electrodes included in the other of the first scan electrode group and the second scan electrode group, wherein the first scan driver and the second scan driver output respective scan pulse voltages to the first scan electrode group and the second scan electrode group, and wherein the first scan driver and the second scan driver output in response to a control signal additional scan pulse voltages to the first scan electrode group and the second scan electrode group respectively, and wherein the control signal is a signal used for sensing generation of a sustained discharge at discharge cells corresponding to the scan electrodes in one of the first scan electrode group and the second scan electrode group over a predetermined time in accordance with checking of an ON/OFF pattern of an externally-inputted image signal, and, in response to such sensing of the generation of the sustained discharge, controlling a discharge to occur in discharge cells corresponding to the scan electrodes in the other of the first scan electrode group and the second scan electrode group.

13. The scan driver apparatus of claim 12, wherein the control signal is used to check an ON/OFF pattern of a frame-based image signal, and to output subfield-based converted image data based on the result of sensing the ON/OFF pattern.

14. The scan driver apparatus of claim 12, wherein the control signal is used to check an ON/OFF pattern of a subfield-based image signal, and to output subfield-based converted image data based on the result of sensing the ON/OFF pattern.

15. The scan driver apparatus of claim 12, further comprising:

a controller having an ON/OFF pattern sensor for sensing generation of a sustained discharge at discharge cells respectively corresponding to the scan electrodes included in one of the first scan electrode group and the second scan electrode group over a predetermined time in accordance with checking of an ON/OFF pattern of an externally-inputted image signal and controlling a discharge to occur in discharge cells respectively corresponding to the scan electrodes included in the other of the first scan electrode group and the second scan electrode group.

* * * * *